US006199393B1

(12) United States Patent
Tesche et al.

(10) Patent No.: US 6,199,393 B1
(45) Date of Patent: Mar. 13, 2001

(54) COMPACT INDOOR UNIT OF AN AIR CONDITIONER

(75) Inventors: Carlos Alfonso Tesche, Canoas; Juan Carlos Carne Correa, Porto Alegre, both of (BR)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/485,561

(22) PCT Filed: Jun. 22, 1998

(86) PCT No.: PCT/BR98/00041

§ 371 Date: Feb. 14, 2000

§ 102(e) Date: Feb. 14, 2000

(87) PCT Pub. No.: WO99/67582

PCT Pub. Date: Dec. 29, 1999

(51) Int. Cl.[7] ..... F25D 23/12
(52) U.S. Cl. ..... 62/262; 62/263; 62/298
(58) Field of Search ..... 62/262, 263, 428, 62/297, 298; 454/276, 355

(56) References Cited

U.S. PATENT DOCUMENTS

| | | | | |
|---|---|---|---|---|
| 2,810,536 | | 10/1957 | Cunningham | 248/19 |
| 4,164,852 | * | 8/1979 | Anzalone | 62/262 X |
| 4,733,542 | * | 3/1988 | Blair | 62/263 |
| 4,951,737 | * | 8/1990 | Tenhundfeld et al. . | |
| 5,638,693 | * | 6/1997 | Baek | 62/262 |

FOREIGN PATENT DOCUMENTS

| | | | |
|---|---|---|---|
| 355085833 | * | 6/1980 | (JP) . |
| WO9826491 | | 6/1998 | (WO) . |

* cited by examiner

*Primary Examiner*—Corrine McDermott
*Assistant Examiner*—Chen-Wen Jiang

(57) ABSTRACT

An air distribution unit of the type including a housing defining an air inlet, an air outlet, and an air flow path therethrough extending from the inlet to the outlet. The unit includes an evaporator coil supported in the housing in the air flow path and a fan and motor assembly for effecting air flow along the air flow path and through the evaporator coil. The housing includes external cover components including a front panel and left and right external side covers. An internal structural framework of the unit supports components internally of the housing and also supports the external components. The framework includes at least one horizontally extending structure member and at least one vertically extending structural side panel structurally attached to the horizontal member in perpendicular relationship thereto. The fan and motor assembly includes a centrifugal fan having a horizontal axis of rotation and an electric motor having an axis coincident with the fan, which is drivingly coupled to the fan. The motor has a cylindrical housing, which has a plurality of mounting tabs extending radially thereform. The vertically extending side panel has an opening therein configured to receive at least a portion of the motor housing therein. The side panel further includes mounting tab engaging structure positioned about the opening. The engaging structure is configured to engage the plurality of mounting tabs of the motor to thereby affix the motor to the side panel.

2 Claims, 4 Drawing Sheets

COMPACT INDOOR UNIT OF AN AIR CONDITIONER

TECHNICAL FIELD

The invention generally relates to air distribution units of the type commonly used in air conditioning, heating or ventilation systems and, more particularly, to an extremely compact air conditioning unit.

BACKGROUND ART

In many commercial air conditioning, heating and ventilating systems, treated air is discharged into an area to be conditioned through an air distribution or conditioning unit. For example, one general type of air conditioning system, often referred to as a split system, includes separate indoor and outdoor units. The outdoor unit includes a compressor, a heat exchanger and a fan. The indoor unit includes a heat exchanger and a fan. In operation, the indoor fan draws air into the indoor unit, through an inlet thereof, and forces the air over the indoor heat exchanger and then out of the indoor unit, through an outlet opening therein.

The outdoor fan draws air into the outdoor unit, through an inlet, forces that air over the outdoor heat exchanger and then forces that air out of the outdoor unit through an outlet therein. At the same time, a compressor causes a refrigeration fluid to circulate through and between the indoor/outdoor heat exchangers. At the indoor heat exchanger, the refrigerant absorbs heat from the air passing over that heat exchanger, cooling that air. At the same time, at the outdoor heat exchanger, the air passing over the heat exchanger absorbs heat from the refrigerant passing therethrough.

Split type air conditioning units of this type are typically manufactured in a wide range of cooling capacities. Accordingly, the size of the indoor unit can range from a small compact relatively narrow unit up to a wide unit, of substantially the same height as the compact unit.

In manufacturing compact units, a particular challenge is mounting all of the necessary components within a confined space. Accordingly, it is desirable to mount the motor and fan assembly in an extremely compact space with a minimum of mounting hardware.

DISCLOSURE OF THE INVENTION

An air distribution unit of the type including a housing defining an air inlet, an air outlet, and an air flow path therethrough extending from the inlet to the outlet. The unit includes an evaporator coil supported in the housing in the air flow path and a fan and motor assembly for effecting air flow along the air flow path and through the evaporator coil. The housing includes external cover components including a front panel and left and right external side covers. An internal structural framework of the unit supports components internally of the housing and also supports the external components. The framework includes at least one horizontally extending structural member and at least one vertically extending structural side panel structurally attached to the horizontal member in perpendicular relationship thereto. The fan and motor assembly includes a centrifugal fan having a horizontal axis of rotation and an electric motor having an axis coincident with the fan, which is drivingly coupled to the fan. The motor has a cylindrical housing, which has a plurality of mounting tabs extending radially thereform. The vertically extending side panel has an opening therein configured to receive at least a portion of the motor housing therein. The side panel further includes mounting tab engaging structure positioned about the opening. The engaging structure is configured to engage the plurality of mounting tabs of the motor to thereby affix the motor to the side panel.

BRIEF DESCRIPTION OF THE DRAWINGS

The invention may be better understood and its objects and advantages will become apparent to those skilled in the art by reference to the accompanying drawings, in which.

BEST MODE FOR CARRYING OUT THE INVENTION AND INDUSTRIAL APPLICABILITY

Figure 1:
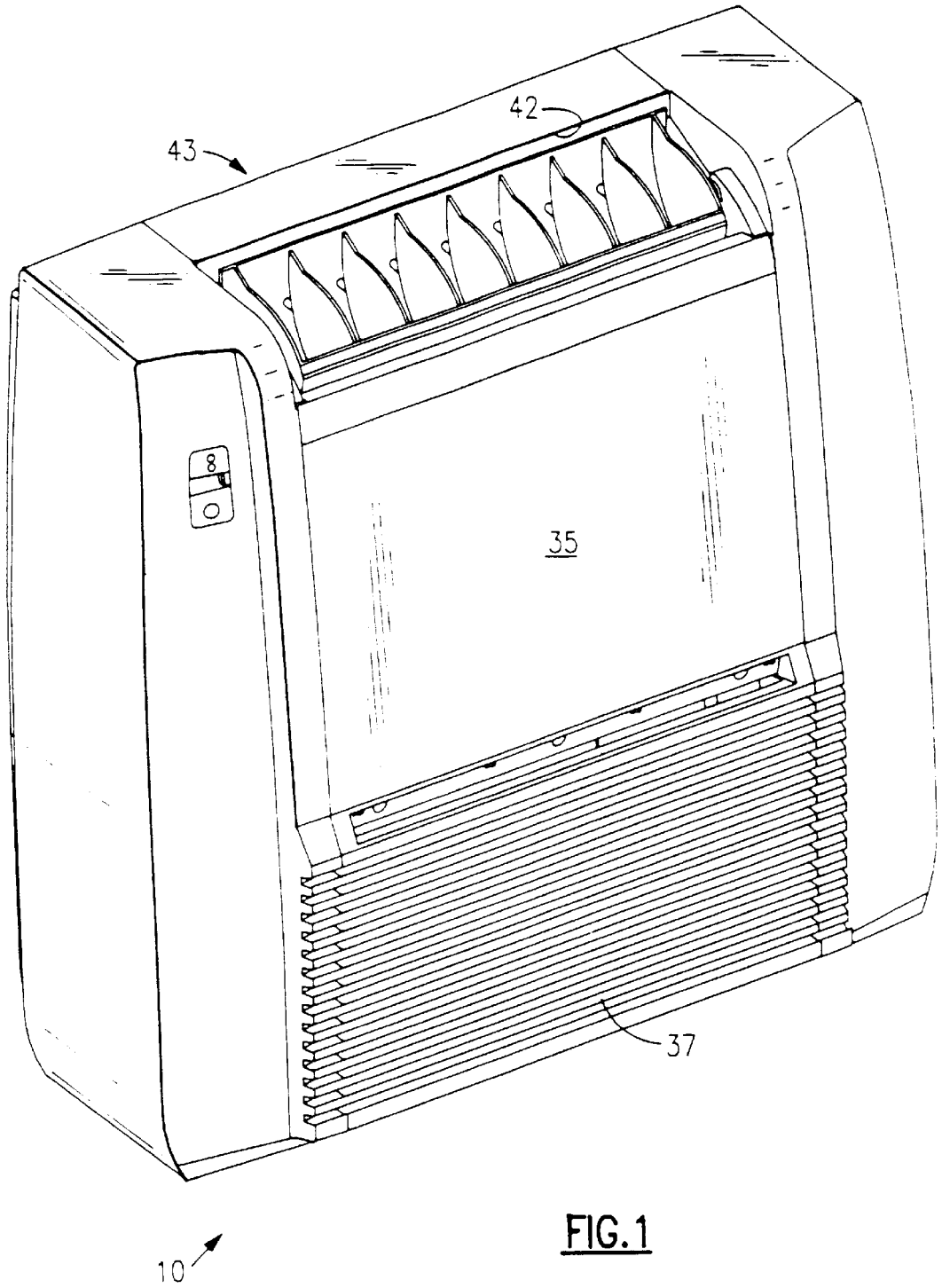
FIG. 1 is a perspective view of the indoor unit of an air conditioner which embodies the features of the present invention.
Figure 3:
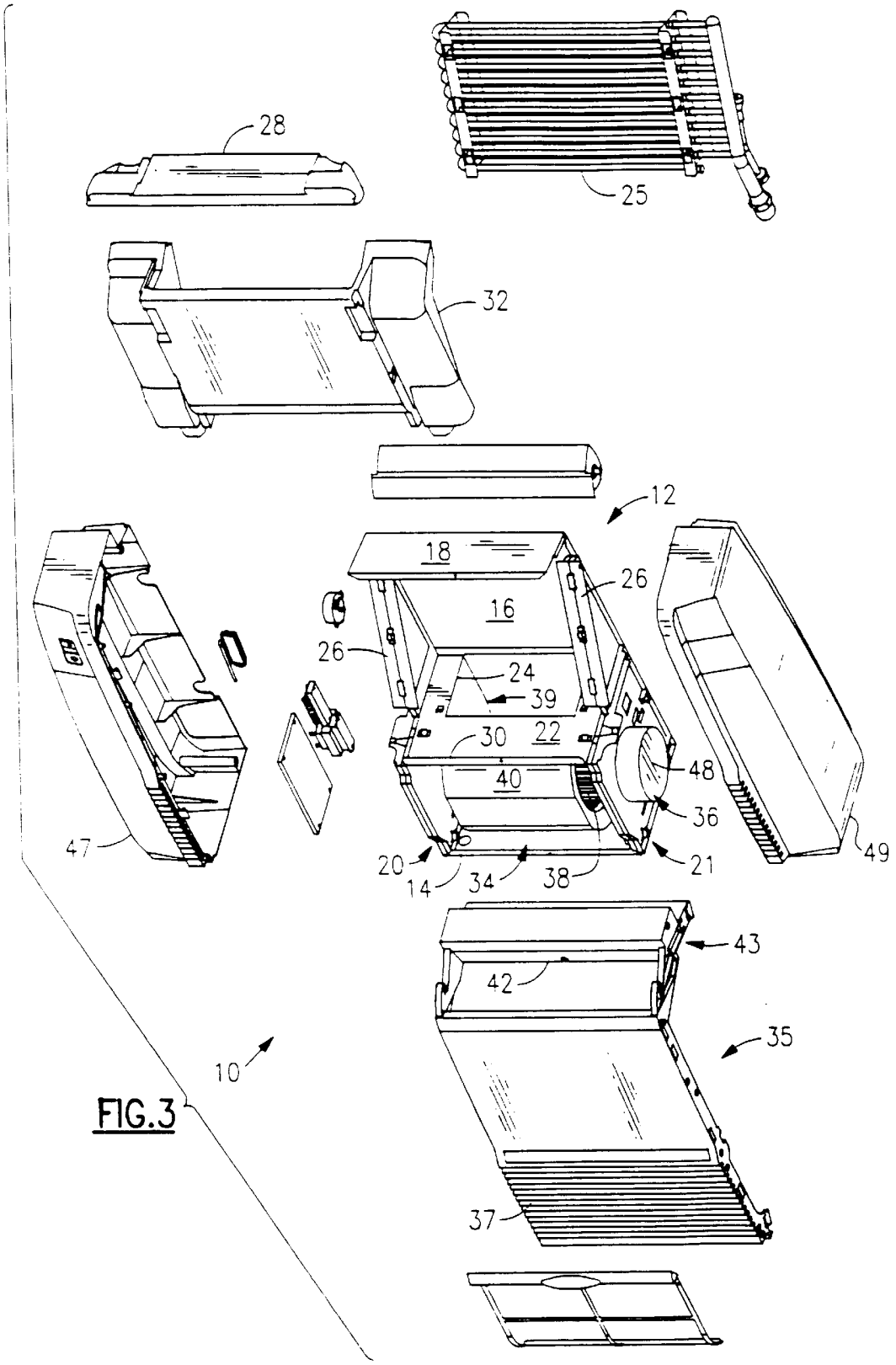
FIG. 3 is an exploded perspective view of the air conditioning unit of FIG. 1.

Looking first a FIGS. 1 and 3, the indoor unit 10 of a split system air conditioning system of the type according to the present invention is illustrated. Briefly, the unit 10 includes a main structural support frame 12, which includes a bottom panel 14, a back panel 16 and a top section 18. Attached to the sides of the back and top panels are structural left and right-hand internal side covers 20 and 21, respectively. The side covers 20 and 21, and the back panel 16 cooperate to support a horizontally extending scroll support panel 22, which includes a rectangular opening 24 formed therein. Mounted above the scroll support panel 22 on a pair of inclined surfaces 26 defined by the internal side covers 20 and 21 is a heat exchanger coil 25.

Mounted under the top section 18 of the main support frame 12 is an upper condensate collection pan 28. Mounted in the front of the unit, under the bottom of the heat exchanger 25, and supported by the front edge 30 are the scroll support panel 22, is a lower condensate collection pan 32. A front section of the lower condensate collection pan extends upwardly and is spaced from the heat exchange coil 25.

As will be described in detail below, mounted to the right-hand internal side cover 21 is a fan assembly 34, which includes an electric motor 36 adapted to drive a centrifugal fan 38. Mounted to the scroll support panel 22 is a two-piece scroll housing 40, which encloses the fan 38. The scroll housing 40 defines a rectangular upper air outlet opening 39, which is in air flow communication with the rectangular opening 24 in the scroll support panel 22.

Front external cover 35 covers the front and top of the unit. The cover includes a louvered inlet section 37 and an upper section 43 having an air discharge opening 42 therein. External side covers 47 and 49 are installed on the left and right sides, respectively.

As a result of the above-described arrangement of components, when the fan assembly is energized, air is drawn into the region 41 underlying the scroll support panel 22, through the inlet louvers 37 and is directed upwardly through the rectangular opening 24 through the heat exchange coil 25 and is discharged through the discharge opening 42.

Figure 2:
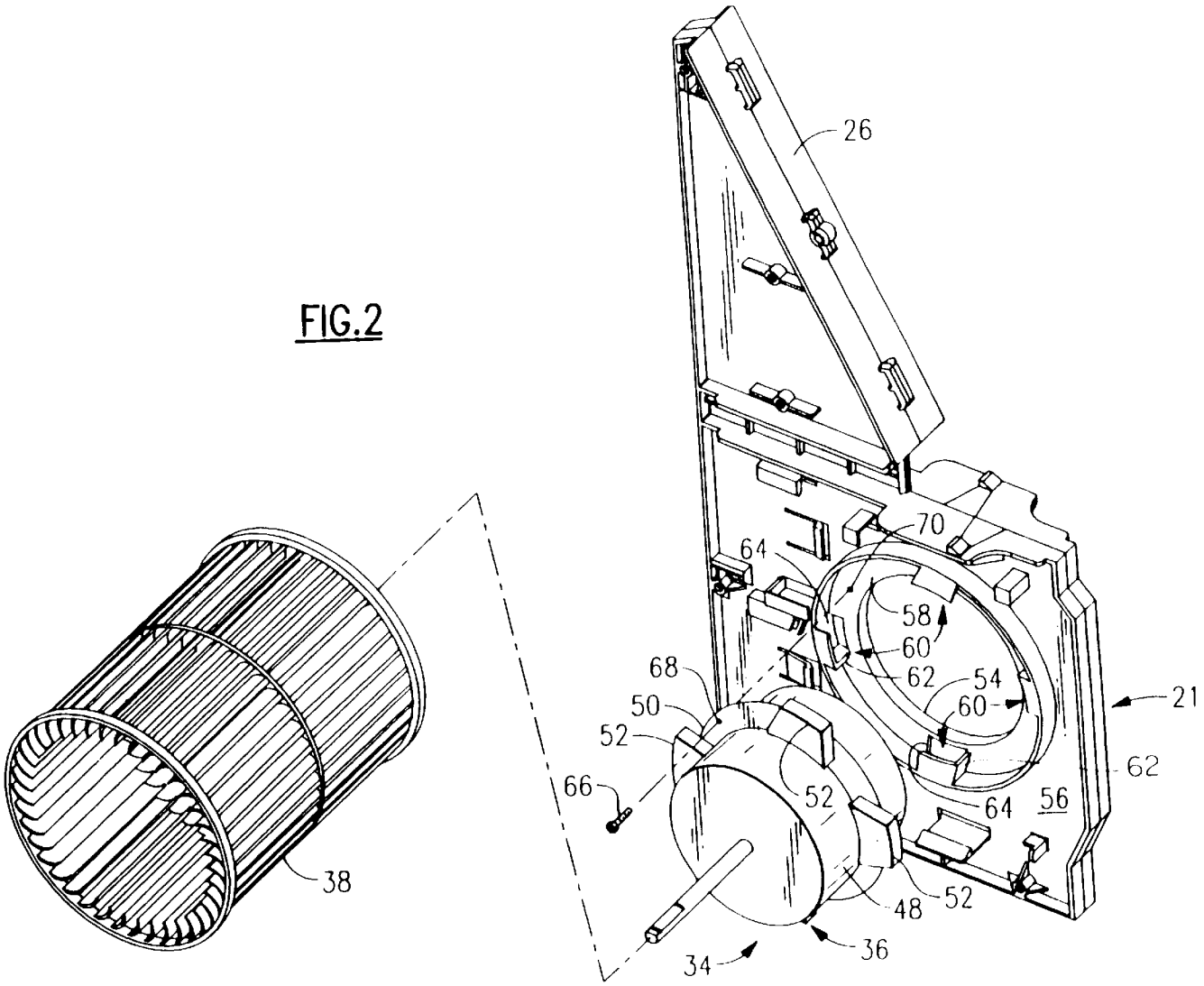
FIG. 2 is a perspective view of the right internal side cover of the air conditioning unit of FIG. 1 showing the fan and fan drive motor to be assembled thereto.

Looking now at FIG. 2, the cylindrical outer housing 48 of the fan motor 36 includes a peripherally extending flange 50, which has four radially outwardly extending lugs 52 equally spaced thereabout.

The right internal side cover 21 is provided with an opening 54, which is sized to receive the right-hand end of the motor housing 48 therein. Located on the interior side 56 of the side cover and peripherally surrounding the opening 54 is a peripherally extending circular grove 58, which is adapted to receive the lugs 52 in confronting relation therewith. Positioned in the grove 58 are four lug receiving cavities 60 having a closed end 62 and an open lug receiving end 64.

According to a preferred embodiment of the invention, each of the lugs 52 is provided with an outer cover preferably made from an elastomeric material. As a result, when the motor housing 48 is passed through the opening 54 and the lugs 52 are positioned in the lug receiving grove 58, and the motor is rotated in a clockwise direction, each of the elastomeric covered lugs 52 will be forced into a mating lug receiving cavity 60. The thickness of the outer cover of the lugs 52 and the size of the cavities 60 are such that a close interference fit is achieved between the lugs and the receiving cavities, particularly as the lugs are rotated to engage the closed end of the cavities. Following such installation, a single threaded fastener 66 may be passed through an opening 68 in the peripheral flange 50 and into a mating opening 70 in the grove 58 to assure that the motor is retained in the installed position.

Figure 4:
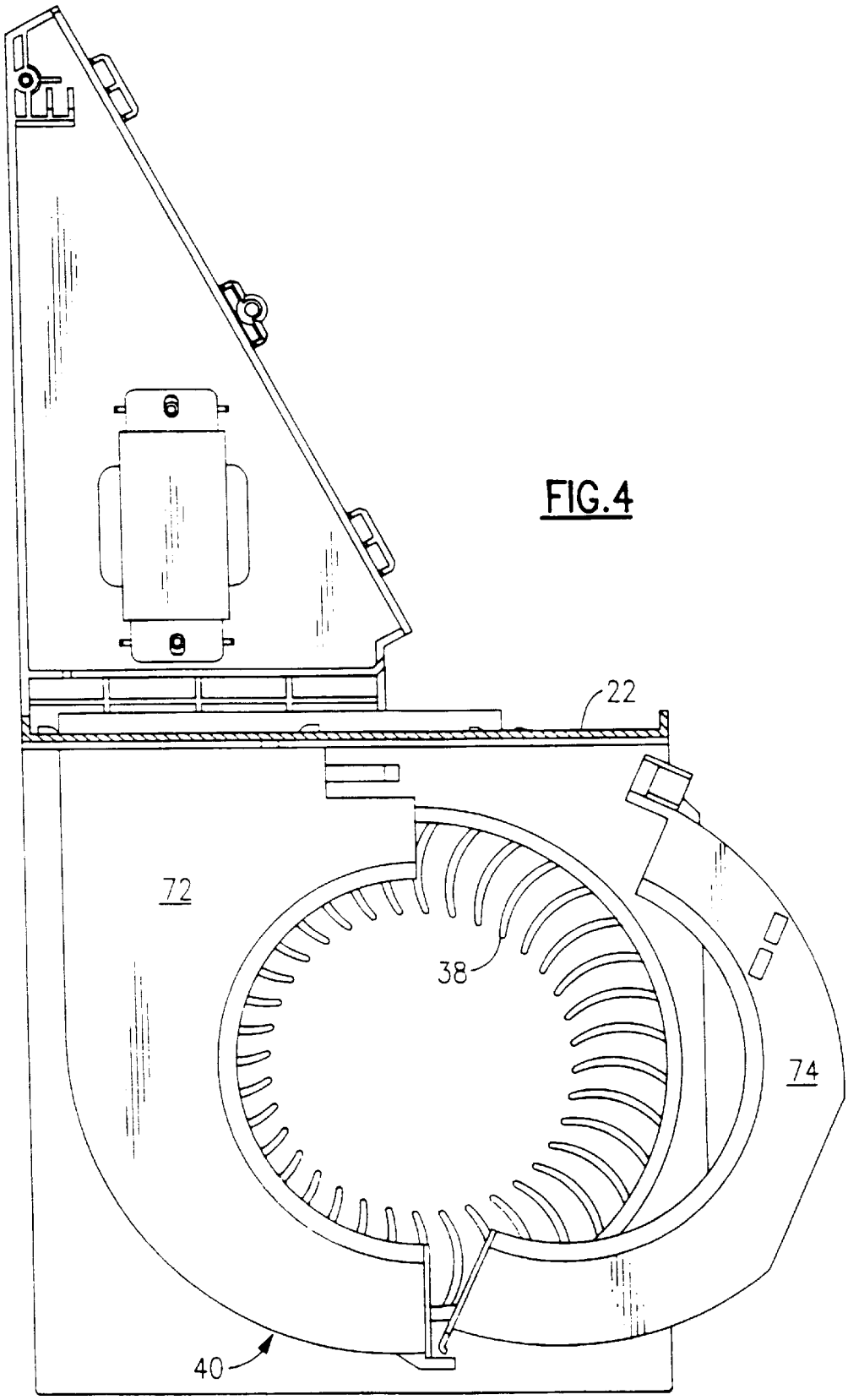
FIG. 4 is a left side view of the air conditioning unit of FIG. 1 with the left side cover removed and the bottom of the left internal side cover broken away to show detail of the fan and scroll housing.

For purposes of a complete understanding of the structure of the unit, reference is made to FIGS. 3 and 4 wherein the two-piece scroll housing 40 is shown. It should be appreciated that prior to installation of the fan and motor assembly 34, as described above, a back section 72 of the two-piece scroll 40 is first installed to the scroll support panel 22. Following installation of the back section 72, the fan and motor assembly 34 is installed, as described above, and completion of the scroll assembly is then achieved by installing a front section 74 of the scroll, as illustrated in FIG. 4.

What is claimed is:

1. An air distribution unit of the type including a housing defining an air inlet, an air outlet, an air flow path therethrough extending from said inlet to said outlet, an evaporator coil supported in said housing in said air flow path, and a fan and motor assembly for effecting air flow along said air flow path and through said evaporator coil, wherein the improvement comprises:

said housing comprising external cover components including a front panel and left and right external side covers;

an internal structural framework for supporting components internally of said housing and for supporting said external cover components, said framework including at least one horizontally extending structural member, and at least one vertically extending structural side panel structurally attached to said at least one horizontal member in perpendicular relationship thereto;

said fan and motor assembly comprising:

a centrifugal fan having a horizontal axis of rotation;

an electric motor having an axis coincident with said fan, drivingly coupled to said fan, said motor having a cylindrical housing having a plurality of mounting tabs extending radially therefrom;

wherein said vertically extending side panel has an opening therein configured to receive at least a portion of said motor housing therein, and further includes mounting tab engaging structure positioned about said opening, said engaging structure being configured to engage said plurality of mounting tabs of said motor housing to thereby affix said motor to said side panel.

2. The apparatus of claim 1 further including at least one threaded fastener adapted to pass through at least a portion of said motor housing and said mounting tab engaging structure to thereby interconnect said housing and said engaging structure.

* * * * *